US005638047A

United States Patent [19]

Orloff et al.

[11] Patent Number: 5,638,047

[45] Date of Patent: Jun. 10, 1997

[54] SOUND ACTIVATED TRANSMITTER

[75] Inventors: Leslie M. Orloff, Cold Spring Harbor; Gary Paley, Cornwall on Hudson; David T. Waugh, Mamaroneck, all of N.Y.

[73] Assignee: Fred M. Schildwachter & Sons, Inc., Bronx, N.Y.

[21] Appl. No.: 438,530

[22] Filed: May 10, 1995

[51] Int. Cl.[6] ..... G08B 1/08

[52] U.S. Cl. ..... 340/539; 340/328; 340/330; 340/331; 340/500; 340/531

[58] Field of Search ..... 340/561, 328, 340/330, 691, 500, 600, 539, 531; 367/197, 198, 199

[56] References Cited

U.S. PATENT DOCUMENTS 4,025,918 5/1977 Beuchamp ..... 340/691
4,297,677 10/1981 Lewis ..... 340/691
4,305,070 12/1981 Samuel ..... 340/691
4,365,238 12/1982 Kollin ..... 367/197
5,365,214 11/1994 Angott ..... 340/691
5,400,011 3/1995 Sutton ..... 340/691

*Primary Examiner*—Jeffery Hofsass
*Assistant Examiner*—Albert K. Wong
*Attorney, Agent, or Firm*—Brooks Haidt Haffner & Delahunty

[57] ABSTRACT

A remote annunciator system in which the emission of an acoustic signal by a first annunciator is detected by an acoustic signal detector which causes a radio frequency transmitter to transmit a radio frequency signal. A radio frequency receiver which receives the signal operates a second annunciator which is remote from the first annunciator, to cause the second annunciator to emit an audible or visual signal. Preferably, the radio frequency signal is encoded and is decoded at the receiver, and if the first annunciator can emit two different accoustic signals, the transmitted signal is encoded dependent upon which acoustic signal is emitted and the receiver decoder causes the second annunciator to emit an audible signal or a visual signal which depends on the transmitted signal encoding.

15 Claims, 7 Drawing Sheets

SOUND ACTIVATED TRANSMITTER

RELATED APPLICATIONS

This application is related to application Ser. No. 08/242,305, filed May 13, 1994 and abandoned and entitled "Combined Audible and Visual Signaling Device", the disclosure of which is incorporated herein by reference.

FIELD OF THE INVENTION

The present invention relates to an annunciator system which includes a sound activated transmitter for transmitting distinctive signals to one or more remote annunciators in response to different events and particularly, to a system for operating one or more other sound and/or light emitting devices when a first sound emitting device is operated.

BACKGROUND OF THE INVENTION

Conventional doorbells, doorchimes or other audible annunciators within a home or other building are typically hardwired to one or more pushbuttons or switches at an entrance door or doors and are activated by a person desiring entrance to the building, generating an audible sound, such as a chime tone, within the home or other building. Since the distance at which the sound of such a primary annunciator or device can be heard is limited, several such annunciators, in addition to the primary annunciator, may be required to alert an occupant of the building, e.g., in a basement, attic, garage or other remote area of the home or other building, as to the operation of the primary device. Since physically interconnecting or hardwiring remote devices to the primary device or to the pushbutton or switches is a complicated and expensive procedure, a different and more cost-effective approach is required.

Ways to activate remote annunciator devices without expensive wiring include transmitting an over-the-air, radio activating signal to a distant device. See, for example, U.S. Pat. No. 4,523,193, which describes a device for remotely activating a distant sound producer by such signal. These devices, however, typically operate by connecting the transmitter to the primary device circuit, thereby sharing a common power source. Thus, upon pressing the activating button and closing an electrical switch therein, the current flowing therethrough that energizes the primary device also energizes the transmitter. Connecting the transmitter of the activating signal so that the transmitter is energized by the power source for the primary device has disadvantages.

First of all, if there are two pushbuttons, at least three electrical connections must be made to the electrical circuit of the primary device which may be acceptable, in many cases, but it is desirable to provide an activating signal transmitter which can be used either with such connections or with fewer such connections. Furthermore, if the transmitter is energized by the same source which energizes the primary device, electrical problems, such as overload or voltage drop, may result.

Secondly, while older forms of annunciators which have solenoids which activate a mechanical sound generating device, such as a tone bar or a bell, will operate when the activating, or pushbutton switch is momentarily closed, there is a newer form of annunciator which includes electronic circuits which simulate the sounds of the older forms, e.g., a chime, and which are physically smaller and simpler. However, such newer form of annunciator requires a continuous supply of electrical energy, that is, even when the pushbutton switch is not closed, in order properly to function. If, in this case, the transmitter of the activating signal will transmit when the annunciator is energized, the transmitter will continuously transmit which, for obvious reasons, is unacceptable.

Thirdly, there is a limited band of radio frequencies in which an activating signal transmitter is permitted, by government regulation, to transmit. Thus, if there are at least two transmitters and two remote receivers in close proximity, within the transmitted power ranges of the transmitters, and the transmitters have substantially the same transmitting frequency, false activation of the remote annunciators can occur. For example, one transmitter can be in one building or apartment, another transmitter can be in another nearby building or apartment and all receivers can be near enough to both transmitters to activate both of their alerting devices, audible or visual, when either transmitter is activated. Since inexpensive receivers which are not highly selective are used, mere shifting of the transmission frequency of one of the transmitters within the limited band may not be sufficient to avoid false signalling.

There also are annunciators which produce audible sounds but which are entirely mechanical, i.e., they do not require an electrical power source or electrical energization, and it is desirable to be able to activate remote annunciators whenever such a non-electric, primary annunciator is activated.

SUMMARY OF THE INVENTION

It is an object of the present invention to provide an improved alerting system which has at least one annunciator remote from the primary annunciator without expensive wiring being necessary between the primary annunciator and the remote annunciator and which overcomes the problems of such prior art systems.

A further object of the invention is to provide a radio frequency transmission system which is triggered by an acoustic signal generated by an annunciator whether or not the annunciator is electrically operated.

A still further object of the invention is to provide an alerting system which, in response to an acoustic signal, sends a radio frequency signal to a remote annunciator to activate the latter.

Another object of the invention is to provide an acoustic signal activated alerting system which transmits a unique radio signal to a selected remote receiver or receivers for each of two or more different events, thereby alerting an individual at a remote location of a particular event.

Another object of the invention is to provide an acoustic signal activated alerting system in which the transmitted radio signal is encoded so that it activates only a selected remote device or devices.

In accordance with the preferred embodiment of the invention, there is provided a sound activated, radio frequency energy transmitter which in response to the sound energy generated by a primary sound generator activated by a switch, e.g. a pushbutton switch, transmits digitally encoded radio frequency signals to a remote receiver/signalling device or devices for activating said remote device or devices. The sound activated transmitter includes an encoder which modulates the radio frequency energy with an address identification code and a data code, identifying the activating sound, and the remote receiver or receivers decodes the address and data codes. If the remote receiver is arranged to respond to the address code received, the remote receiver/signalling device generates the acoustic and/or visible signal indicated by the data codes.

While the present invention has other applications, it will be described with reference to an embodiment in which the audible signals of a conventional door chime of the type that provides distinctive signals indicative of the operation of a doorbell button switch at either a front or a back door of a dwelling or the like activate a transmitter which sends coded signals to remote devices which provide audible and/or visual signals.

BRIEF DESCRIPTION OF THE DRAWINGS

Other objects and advantages of the present invention will be apparent from the following detailed description of the presently preferred embodiments thereof, which description should be considered in conjunction with the accompanying drawings in which.

As used herein, the terms "audible" and "sound" refer to acoustic energy which can be heard by the human ear and normally is in the range from about 60 Hz to 20,000 Hz and preferably, is in the range from about 100 Hz to 5000 Hz. The terms "visible" and "visual" refer to light energy which can be seen by the human eye. Each type of energy is a human observable signal.

Figure 1:
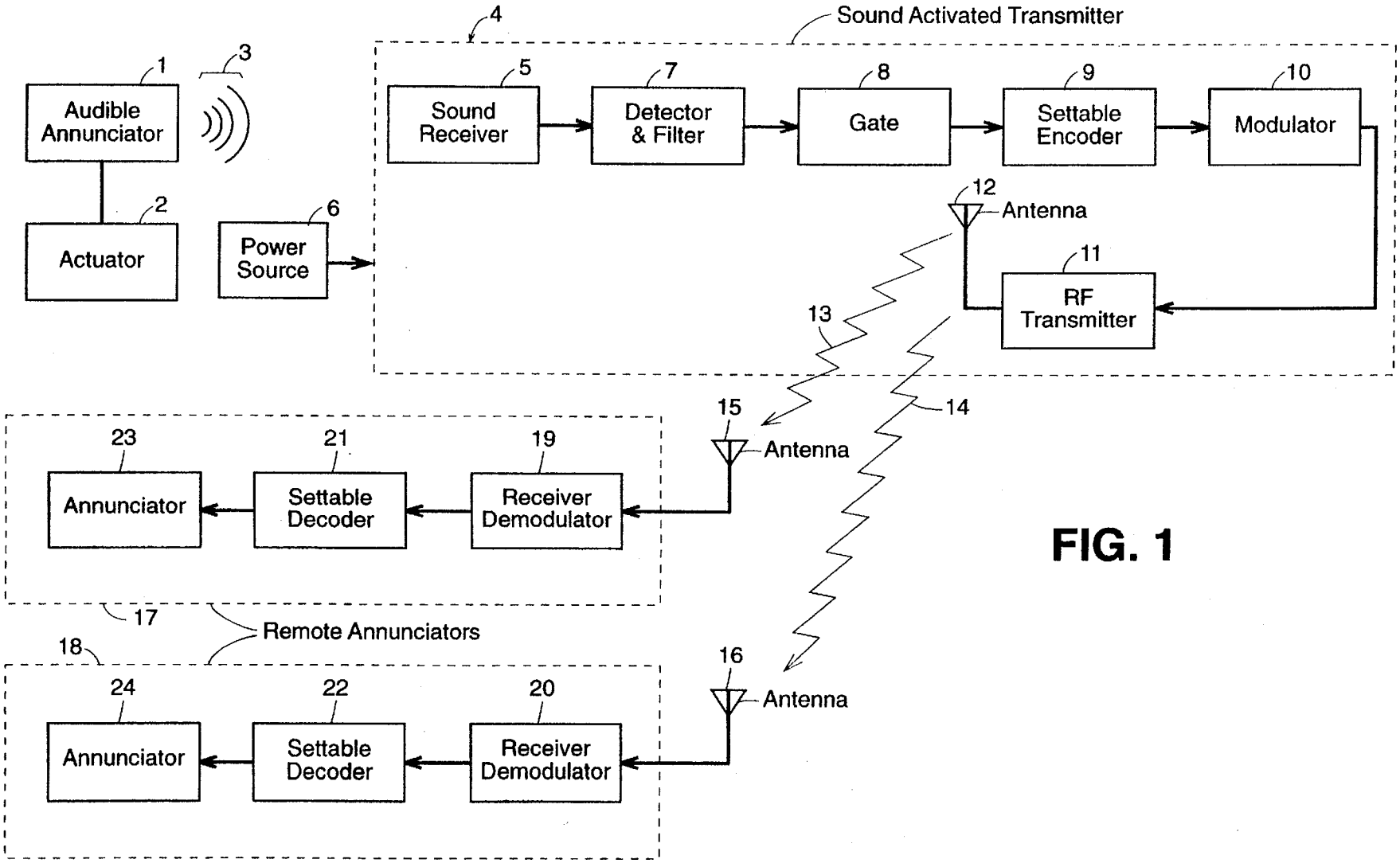
FIG. 1 is a schematic, block diagram illustrating the principles of the invention.

The general principles of the invention are illustrated in FIG. 1. An annunciator 1, when energized by an actuator 2, produces sound energy represented by the waves 3. The annunciator can be, for example, a buzzer, a tone bar, a chime tube or tubes, or an electronic sound-producing device activated electrically or a tone bar or chime tube or tubes activated mechanically. The actuator 2 can be operated by hand, for example, by pushing a button, or can be operated by a switch indicating the opening of a door or window or by a known type of detector which indicates the passage of an object, e.g. a person, through an opening in a building. A specific embodiment of the invention in which the annunciator is operable electrically and is activated by either of two switches to provide sound energy of two different frequencies, depending on which switch is operated, will be described hereinafter.

A sound activated transmitter 4 includes a sound receiver 5, e.g. a microphone, which converts sound energy into electrical energy. The transmitter 4 is connected to an electrical power source 6 which can be the same as the power source for the annunciator 1, if the latter has an electrical power source, or can be a separate electrical power source particularly when the annunciator 1 is merely mechanically operated.

The sound receiver 5 is located near to the annunciator 1 so that sufficient sound energy from the annunciator 1 is received by the receiver 5. The sound energy is normally in the range from 500 to 1000 Hz and the electrical output of the receiver 5 will include signals in the same range. The output signals of the receiver 5 are supplied to a detector and filter 7 which amplifies the signals and limits the transmitter 4 response. Thus, to reduce the possibility of activation of the transmitter 4 by sound energy produced other than by the annunciator 1, the filter restricts any significant output of the detector-filter to signals from the receiver 5 to the 500–1000 Hz range. Of course, if the annunciator 1 provides sound energy in a different range, the filter would restrict output to signals in the latter range. The detector-filter 7 preferably also includes a sound duration circuit which will also restrict output from the detector-filter 7 not only to sound energy from the annunciator 1 of a frequency in the range of the filter, but also to sound energy of a predetermined duration, e.g. about 100 milliseconds.

Accordingly, when sound energy of the correct frequency and of a predetermined duration is received by the sound receiver 5, the detector-filter 7 turns on an electrical gate 8 which energizes a settable encoder 9 which provides a digitally encoded signal, related to the remote annunciator to be energized, to a modulator 10 which energizes and modulates a radio frequency transmitter 11. Encoded radio frequency energy is radiated by the transmitting antenna 12, as indicated by the lines 13 and 14, and is received by the receiving antennae 15 and 16 forming part of the remote annunciators 17 and 18 which can be identical. It is assumed that both remote annunciators are to be energized when the transmitter 11 transmits and that one annunciator, 17 or 18, is at one location and the other annunciator, 17 or 18, is at another location. However, it will be apparent that only one annunciator, 17 or 18, can be provided and that more than two annunciators 17 and 18 can be used.

The radio frequency energy received by the antennae 15 and 16 is received and demodulated by receiver-demodulators 19 and 20, the electrical outputs of which are supplied to the settable decoders 21 and 22. If the coded signals received by the decoders 21 and 22 correspond to the settings of the decoders 21 and 22, the decoders 21 and 22 electrically energize the annunciators 23 and 24 which may be of a known type, e.g. an electrically operable speaker, a strobe light, a piezo-electric transducer, etc.

Figure 2:
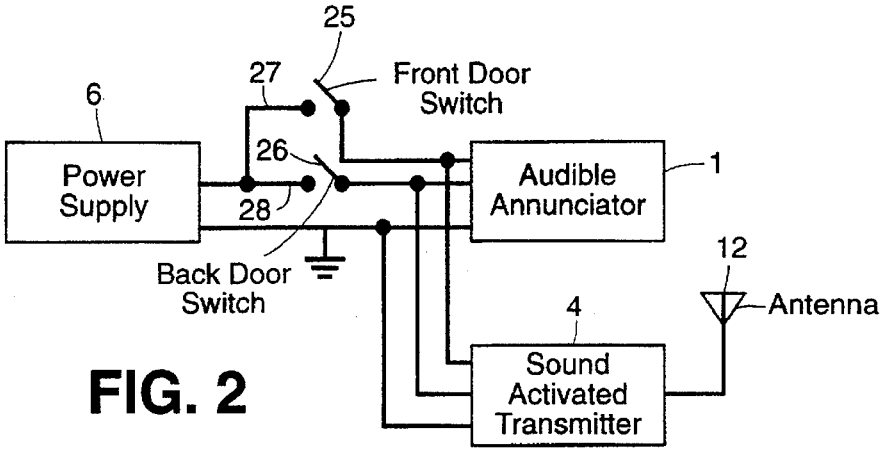
FIG. 2 is a schematic, block diagram illustrating electrical connection of the sound activated transmitter to the power source of the audible annunciator.

While the audible annunciator 1 can have a single frequency sound output, it is customary to provide an annunciator which provides different tones, or audible sounds, depending upon whether an actuator 2 at one entrance, e.g. front door, or an actuator 2 is at another entrance, e.g. a back door, is actuated. FIG. 2 illustrates the use of the invention in a system in which the audible annunciator 1 and the sound activated transmitter receive electrical power from a common power source 6 and the annunciator 1 is electrically energizable by either a front door push button switch 25 or a rear door switch 26 and provides two different audible sounds, one sound when the front door switch 25 is closed and another sound when the rear door switch 26 is closed. Such an annunciator is well known in the art.

However, with the system of FIG. 2, i.e. with an annunciator 1 which provides two different sounds depending upon which switch 25 or 26 is actuated, it is desirable, although not necessary, that the annunciators 23 and 24 also indicate which switch 25 and 26 is actuated.

Figure 3:
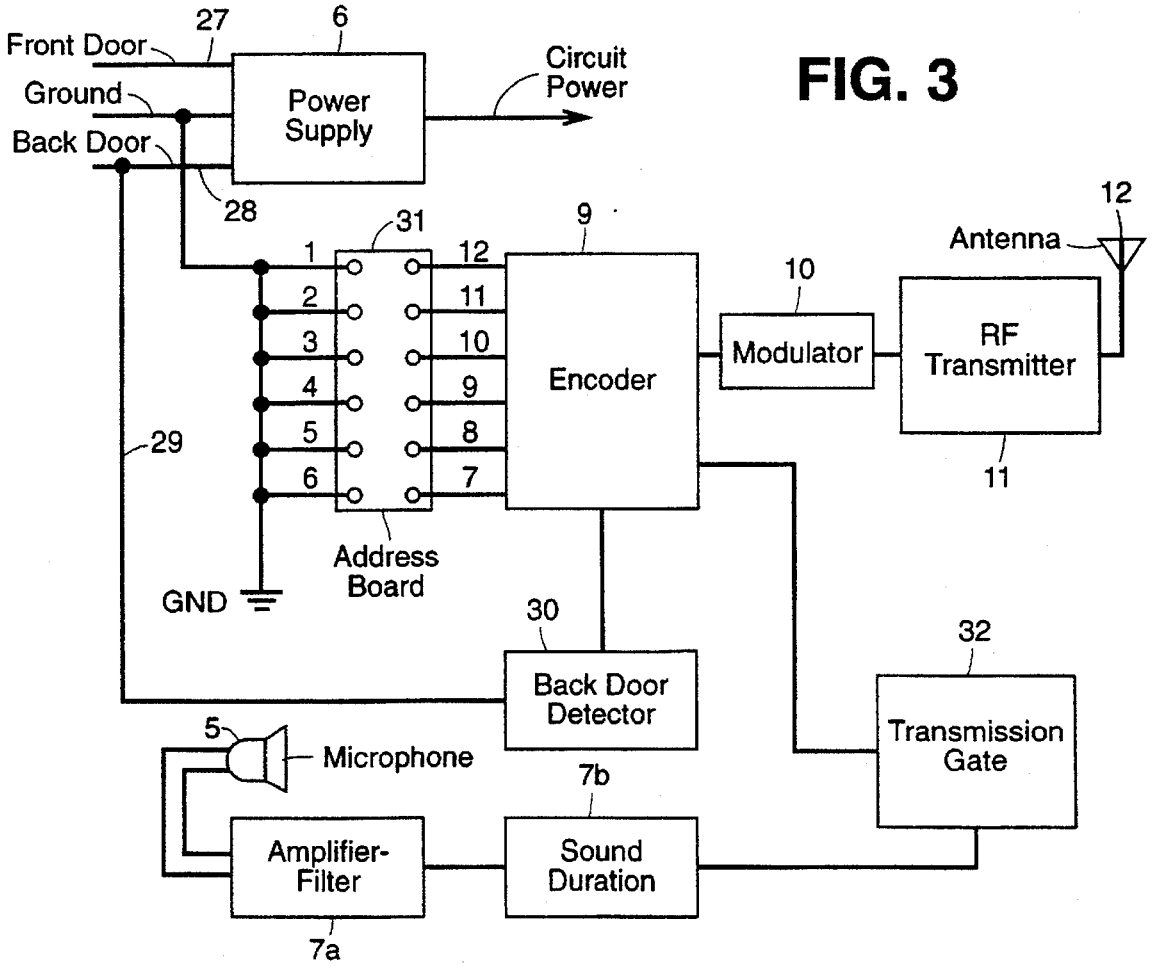
FIG. 3 is a schematic, block diagram of the transmitter shown in FIG. 2.

FIG. 3 illustrates apparatus for transmitting differently coded signals to the remote annunciators 17 and 18 for indicating which switch, 25 or 26, is actuated. As indicated in FIGS. 2 and 3, the wires or lines 27 and 28 to the switches 25 and 26 are connected to the annunciator 1 so that the annunciator 1 is energized by either switch 25 or 26. However, as shown in FIG. 3, the line 28 is also connected by a wire or line 29 to a back door detector 30 which will be described in greater detail hereinafter. The detector 30 is connected to the encoder 9 so that if the back door switch 26 is actuated, the coded signal provided by the encoder 9 to the transmitter 11 is different from the coded signal provided to the transmitter 11 when the front door switch 25 is actuated. By interconnection of the terminals 1–12 of the address board 31 in various ways, the address code, i.e. the coded signal to which remote annunciators 17 and 18 respond, can be changed.

In FIG. 3, the detector-filter 7 of FIG. 1 is illustrated as two components, an amplifier-filter 7*a* and a sound duration measuring circuit 7*b*. When the sound receiver 5, illustrated as a microphone in FIG. 3, receives sound of the proper frequency, i.e., within the band pass range of the filter, and of the proper duration, e.g., 100 milliseconds, a transmission gate 32 connected to the sound duration circuit 7*b* causes the encoder 9 to transmit to the modulator 10 a signal which bears an address code and a code indicating which switch, 25 or 26, has been actuated.

Figure 4:
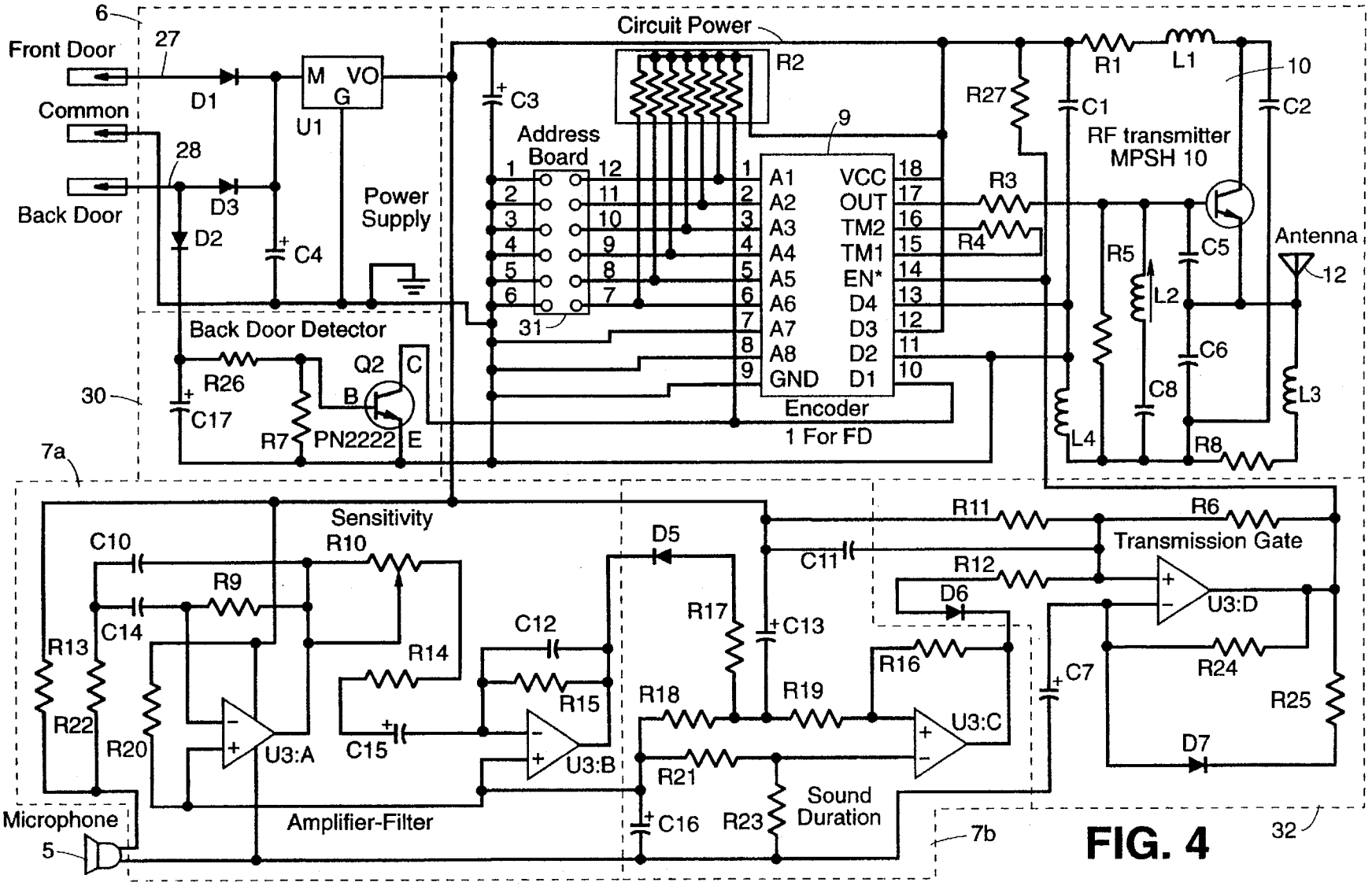
FIG. 4 is a circuit diagram of a sound activated transmitter which can be used as the transmitter shown in FIGS. 1–3.

FIG. 4 is a circuit diagram of an assembly of circuits known to those skilled in the art which can be used to implement the functions described in connection with FIG. 3. Thus, a conventional power supply 6 with diode isolators D1–D3 supplies DC power to the switches 25 and 26 and the audible annunciator 1 and to the remaining circuits shown in FIG. 4. When the front door switch 25 is actuated, the annunciator 1 emits a sound of a first frequency which is received by the sound receiver or microphone 5, the output of which is amplified in the amplifier of the amplifier-filter 7*a*, i.e. the amplifier U3:A and associated circuits. The filter comprising the amplifier U3:B and associated circuits provides a significant output only when the sound signal received by the receiver 5 is within the band frequency range, e.g. 500–1000 Hz, determined by the values of the components associated with the amplifier U3:B.

The sound duration circuit comprising the amplifier U3:C and associated components provides a significant output only when the signal passed by the filter continues for a predetermined time, e.g. 100 milliseconds. The output of the sound duration circuit causes the transmission gate circuit comprising the amplifier U3:D and associated components arranged as a multivibrator to apply a voltage to the encoder 9 comprising a microprocessor of a known type, such as a type HT-12E encoder sold by HOLTEK, which when energized by the transmission gate 32 provides a digitally encoded signal to the RF transmitter 10 and causes the latter to transmit energy at a radio frequency and modulated by the encoded signal.

For example, the encoded signal is coded in binary code and can have 12 bits comprising 6 address bits, 2 fixed bits, 3 data bits and 1 fixed bit. The code is determined by interconnecting terminals 1-6 on the address board 31 with terminals 7-12 on the address board 31 by conductive jumpers. Thus, when a jumper is missing a binary 1 is transmitted and when a jumper interconnects terminals, a zero is present in the code. For example, when all the terminals 1-6 are interconnected, respectively, with terminals 12-7, the address code is six zeros. When all jumpers are missing, the address code is six ones. Obviously, the address code can be selected by interconnecting the appropriate terminals.

The coded signals will be transmitted by the transmitter 10 as long as the gate 32 is "on", usually for a few repetitions of the transmission of the coded signals. If the sound from the annunciator 1 continues, longer than the "on" time of the gate 32, e.g. for a few seconds, the gate 32 will again turn on and again transmit the coded signals a few times.

If the front door switch 25 is actuated, the coded signals will contain two data bits indicating operation of the switch 25. If the back door switch 26 is actuated, the back door detector 30 is energized and applies a voltage to the encoder which will change the data bits to indicate actuation of the back door switch 26 rather than the front door switch 25. Accordingly, the coded signals transmitted by the transmitter 10 include address bits and data bits indicating which switch, 25 or 26, is actuated.

Figure 5:
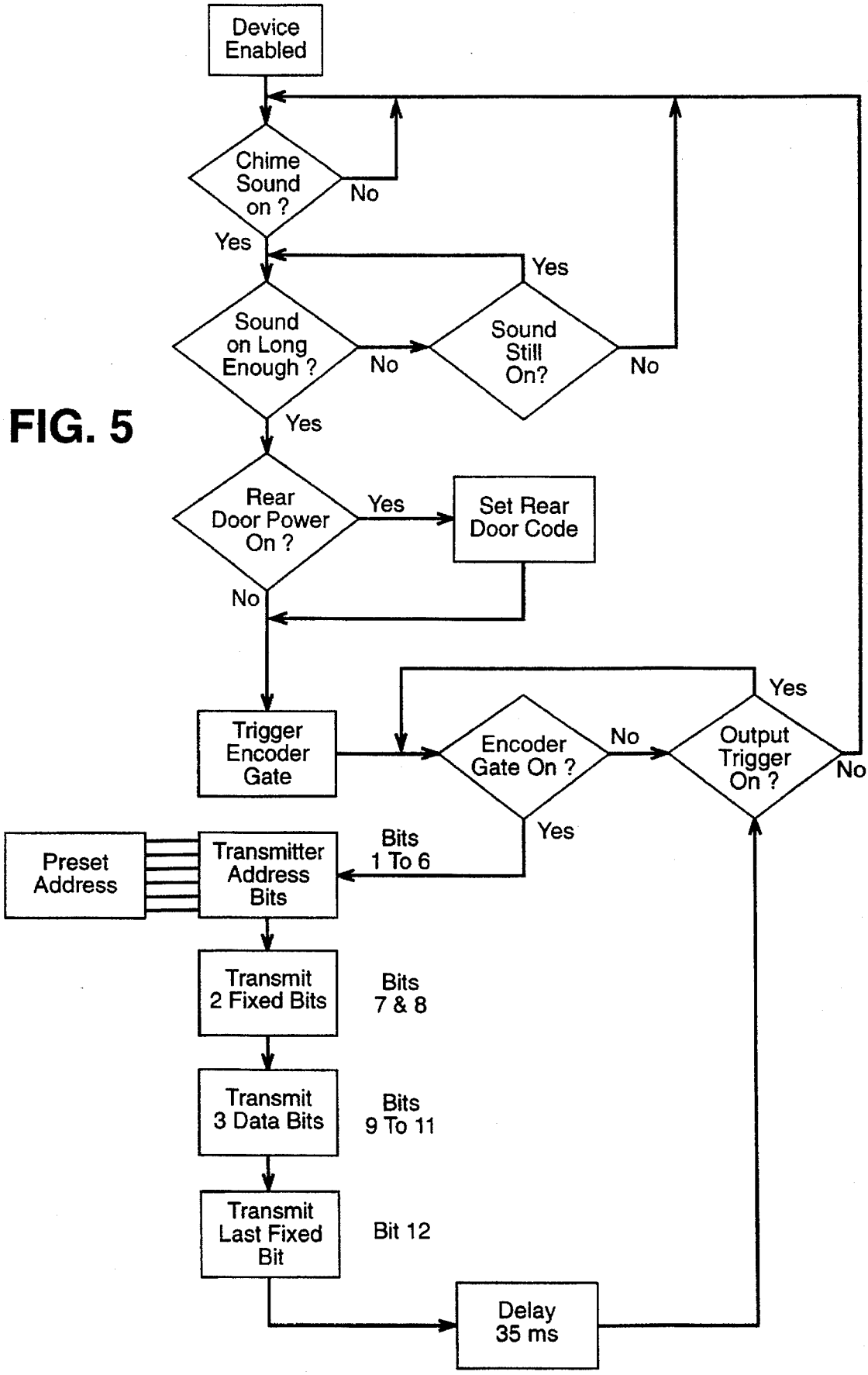
FIG. 5 is a flow diagram illustrating the operation of transmitter shown in FIGS. 3 and 4.

FIG. 5 is a self-explanatory flow diagram illustrating the operation of the apparatus shown in FIG. 4.

Figure 6:
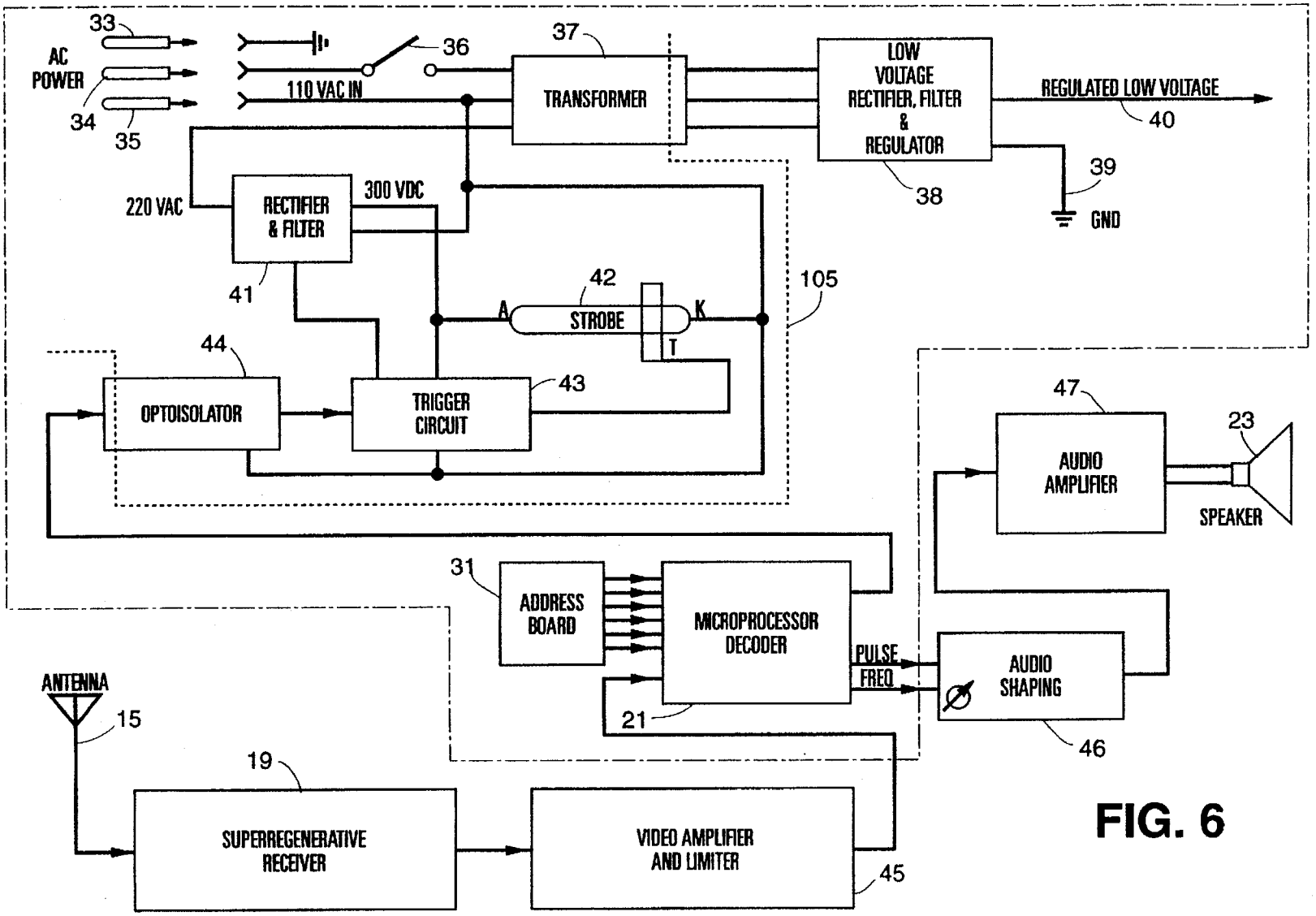
FIG. 6 is a schematic, block diagram of an audible and visible annunciator which can be used as a remote annunciator.

FIG. 6 is a block diagram of a remote annunciator 17 or 18 which can be employed in the invention. Prongs 33–35 represent the prongs of a plug at the end of an AC power cord which connect a device to an AC power outlet. When plugged into the outlet and the switch 36 is closed, the transformer 37 is energized. The transformer 37 supplies low voltage, e.g. 12 volts, power to the low voltage rectifier, filter and regulator 38 which provides, at lines 39 and 40, low voltage DC power for energizing various circuits hereinafter described.

The transformer 37 also supplies higher than line voltage power to a rectifier and filter 41 which supplies high voltage DC power to a strobe lamp 42 and a trigger circuit 43. The trigger circuit 43 is triggered by a signal from an optoisolator 44 when it receives a signal from the microprocessor decoder 45. The strobe lamp 42 and its associated circuits and operation are described more fully in said application Ser. No. 08/242,305 and can be omitted if desired. However, the strobe lamp 42 and its associated circuits provide a visible annunciator which can be useful when the person to be alerted is hard of hearing or deaf.

The remainder of the circuits illustrated in FIG. 6 are also described in detail in said application Ser. No. 08/242,305, but, briefly summarizing, the RF encoded signals received by the antenna 15 are supplied to a super-regenerative receiver 19, the signal output of which is supplied to a video amplifier and limiter 45. The signal output of the amplifier and limiter 45 is supplied to the microprocessor decoder 21, the code which will cause the decoder 21 to provide an output being settable by an address board 31 like the address board 31 of the transmitter circuits shown in FIGS. 3 and 4. When a signal of the correct address code is received by the decoder, it then provides an output signal which is dependent on the data bits. i.e. depending on whether data bits corresponding to the front door switch 25 or to the back door switch 26 actuation are received. The output signal of the decoder 21 is shaped in the audio shaping unit 46 and supplied to the audio amplifier 47 from which the signal is supplied to the annunciator-speaker 48 to energize the latter with a tone distinctive of whether the switch 25 or the switch 26 is actuated.

Figure 7:
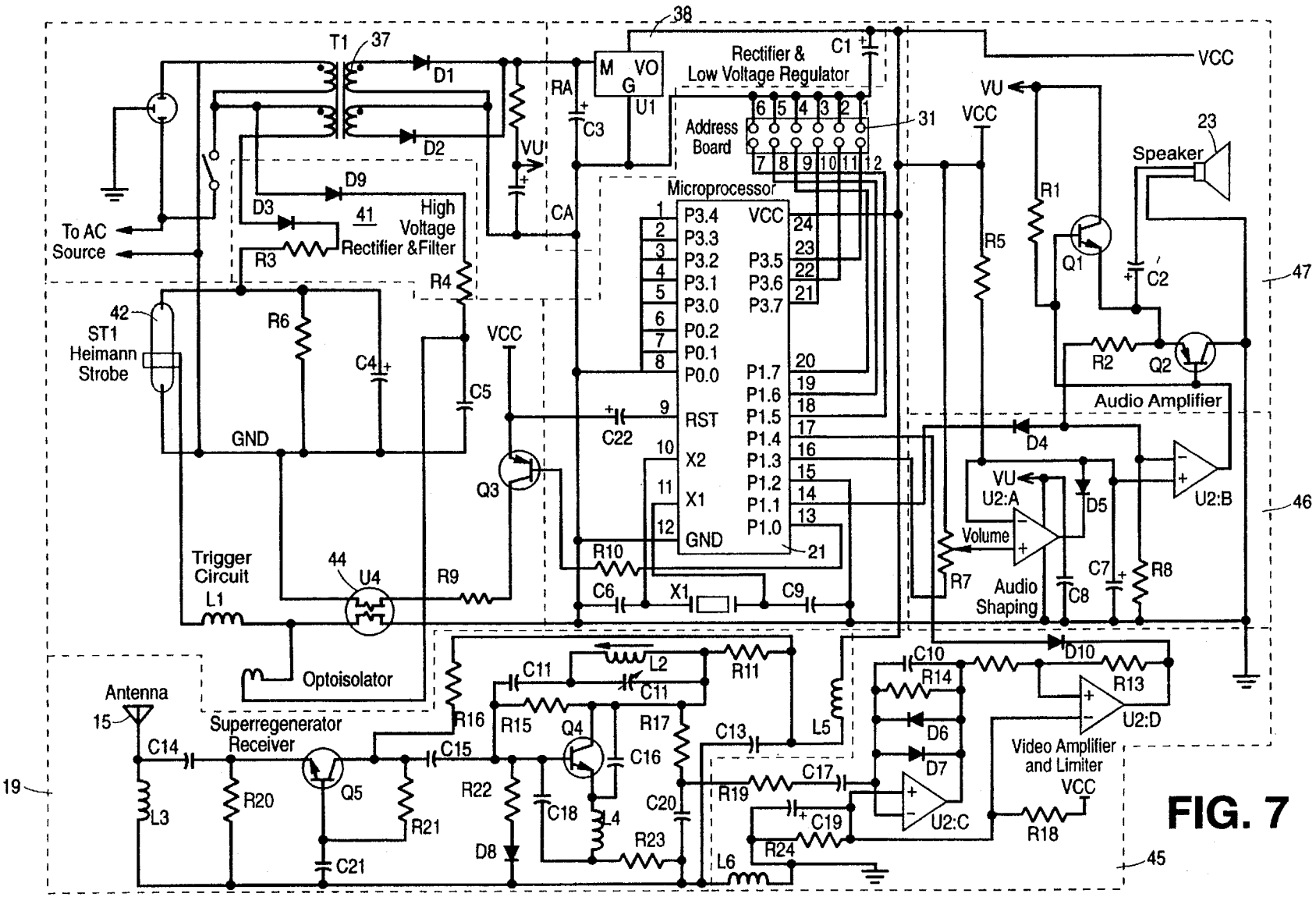
FIG. 7 is a circuit diagram of a remote annunciator which can be used as the remote annunciator shown in FIG. 6.

FIG. 7 is a circuit diagram of an assembly of known circuits which can be used for the remote annunciators 17 and 18. The circuit diagram of FIG. 7 corresponds to the circuit diagram of FIG. 6 of said application Ser. No. 08/242,305 and to the block diagram of FIG. 6 herein. The circuit diagram of FIG. 7 is described more fully in said application Ser. No. 08/242,305 and reference numerals used in FIG. 6 herein are applied to FIG. 7. Accordingly, the purpose and function of the circuits shown in FIG. 7 will be apparent to those skilled in the art from the description given in connection with FIG. 6 herein and in connection with FIG. 6 in said application Ser. No. 08/242,305.

Figure 8:
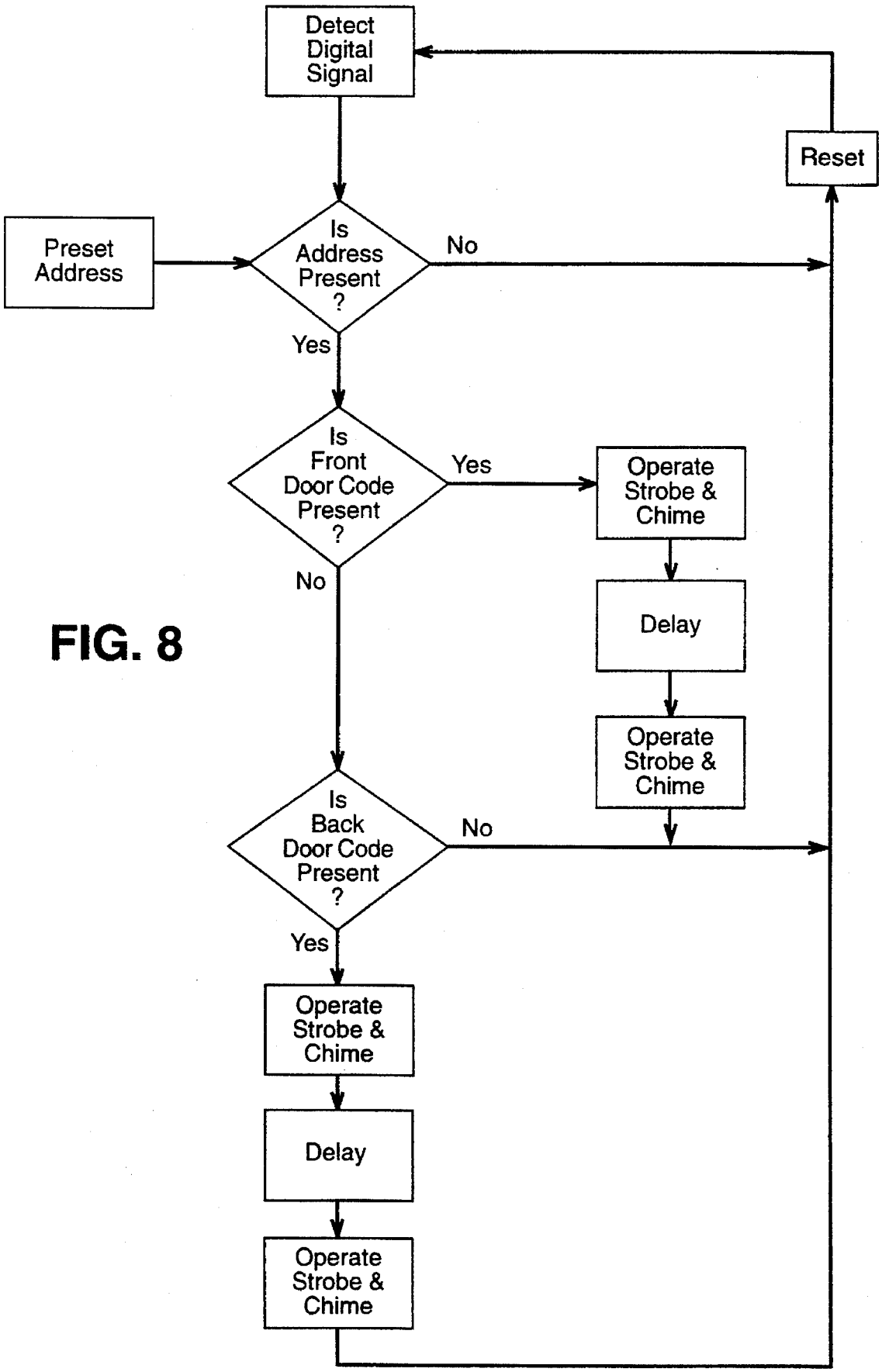
FIG. 8 is a flow diagram illustrating the operation of the remote annunciator shown in FIGS. 6 and 7.

FIG. 8 is a self-explanatory flow diagram illustrating the operation of the apparatus shown in FIGS. 6 and 7.

From the foregoing, it will be apparent that in the simplest embodiment of the system of the invention, there is a sound activated transmitter which transmits an address encoded RF signal when it receives sound energy in a predetermined frequency range, and there is a remote annunciator comprising an RF receiver, a decoder and an audible or visible annunciator, or both. Only the remote annunciator set to accept the address code on the transmitter RF signal will cause actuation of its annunciator. If the source of the sound has more than one actuator, such simple embodiment does not indicate at the remote annunciator which actuator was actuated.

In the preferred embodiments of the simple system and in other embodiments, there is means for measuring the duration of the activating sound which prevents activation of the transmitter unless the sound in said predetermined range continues for at least a predetermined time.

In a more elaborate embodiment of the invention in which the sound source has two actuators, the transmitter transmits an RF signal encoded not only with an address but also with information as to which actuator was operated, and the remote annunciator provides an indication as to which sound source actuator was operated. Although in the more elaborate embodiment of the invention described in detail, the sound activated transmitter is conductively connected to one of the sound source activators, it will be apparent to those skilled in the art that other methods of distinguishing between the operation of the sound source actuators can be employed. For example, if the sound source provides sound energy of first frequencies when one actuator is actuated and sound energy of different second frequencies when the other actuator is actuated, the amplifier-filter 7*a* can be designed to distinguish between the two different energies and cause operation of the encoder 9 in the same manner as the back door detector without a conductive connection between the transmitter and the sound source actuators.

Also, although in the embodiments described, the RF signal is modulated with a binary coded signal and is preferred, it will be apparent that other known types of encoding can be employed.

Although preferred embodiments of the present invention have been described and illustrated, it will be apparent to those skilled in the art that various modifications may be made without departing from the principles of the invention.

We claim:

1. A remote annunciator system for indicating, at a point remote from a first annunciator which can emit an acoustic signal when actuated, the emission of an acoustic signal by said first annunciator, said system comprising:

a transmitter unit comprising:

an acoustic signal detecting means positionable adjacent to said first annunciator for receiving acoustic energy of an acoustic signal emitted by said first annunciator and providing an output signal in response to the acoustic energy of the acoustic signal emitted by said first annunciator; and a radio frequency transmitter electrically connected to and responsive to said output signal of said detecting means for transmitting a radio frequency signal upon receipt by said detecting means of acoustical energy of the acoustic signal emitted by said first annunciator;

a remote annunciator unit positionable remotely from said transmitter unit and comprising:

a radio frequency receiver for receiving said radio frequency signal from said radio frequency transmitter; and a second, annunciator electrically connected to said radio frequency receiver for emitting a human observable signal when said radio frequency receiver receives said radio frequency signal.

2. A remote annunciator system as set forth in claim 1 wherein said human observable signal is an acoustic signal.

3. A remote annunciator system as set forth in claim 1 wherein said human observable signal is visible light.

4. A remote annunciator system as set forth in claim 1 wherein said acoustic signal detecting means comprises an acoustic energy signal receiver which converts acoustic energy to electrical energy and electrical filter means coupling said acoustical energy receiving means to said transmitter for limiting the transmission of said radio frequency signal by said radio frequency transmitter to the receipt by said acoustic signal detecting means of an acoustic signal in a frequency range less than the frequency range to which the human ear is responsive.

5. A remote annunciator system as set forth in claim 4 wherein said frequency range is from about 500 to about 1000 Hz.

6. A remote annunciator system as set forth in claim 1 wherein said acoustic signal detecting means comprises acoustic signal duration means for limiting the transmisson of a radio frequency signal by said radio frequency transmitter to the receipt by said acoustic signal detecting means of an acoustic signal having at least a minimum duration.

7. A remote annunciator system as set forth in claim 6 wherein said minimum duration is about at least 100 miliseconds.

8. A remote annunciator system as set forth in claim 1 wherein said transmitter unit further comprises encoding means electrically coupling said acoustic signal detecting means to said radio frequency transmitter for modulating said radio frequency signal with a code.

9. A remote annunciator system as set forth in claim 8 wherein said code is a digital code.

10. A remote annunciator system as set forth in claim 8 wherein said remote annunciator unit further comprises a decoding means electrically coupling said radio frequency receiver to said second annunciator for limiting the emission of a human observable signal by said second annunciator to the receipt by said radio frequency receiver of said radio frequency signal modulated by said code.

11. A remote annunciator system as set forth in claim 8 wherein said first annunciator emits two different acoustic signals and wherein said encoding means modulates said radio frequency signal with a first code when said first annunciator emits one of said two different acoustic signals and with a second, different code when said first annunciator emits the other of said two different acoustic sounds.

12. A remote annunciator system as set forth in claim 11 wherein said first annunciator is electrically operable and is electrically connectible to an electrical power source by two different switch means and wherein said encoding means is electrically connectible to said electrical power source by one of said switch means for controlling the code with which said encoding means modulates said radio frequency transmitter.

13. A remote annunciator system as set forth in claim 11 wherein said second annunciator can emit two different human observable signals further comprising decoding means electrically connected to said radio frequency receiver and to said second annunciator for causing said annunciator to emit one of said human observable signals when said receiver receives a radio frequency signal modulated with said first code and to emit the other of said human observable signals when said receiver receives a radio frequency signal modulated with said second code.

14. A remote annunciator system as set forth in claim 13 wherein said two different human observable signals are acoustic signals.

15. A remote annunciator system as set forth in claim 13 wherein said two different human observable signals are visible light signals.

* * * * *